United States Patent [19]

Harbaugh

[11] 4,261,157

[45] Apr. 14, 1981

[54] COIN WRAPPING DEVICE

[75] Inventor: Kenneth H. Harbaugh, Gland, Switzerland

[73] Assignees: Michael Radmer; NGZ Geldzählmaschinengesellschaft mbH & Co. Fertigungs-KG, Berlin, Fed. Rep. of Germany

[21] Appl. No.: 88,248

[22] Filed: Oct. 25, 1979

[51] Int. Cl.[3] ..... B65B 11/04

[52] U.S. Cl. ..... 53/212

[58] Field of Search ..... 53/212, 380; 133/1 A, 133/8 A

[56] References Cited

U.S. PATENT DOCUMENTS 2,709,880 6/1955 Jorgensen ..... 53/212

4,069,647 1/1978 Hopie ..... 53/212

FOREIGN PATENT DOCUMENTS 601875 7/1978 Switzerland ..... 133/1 A

*Primary Examiner*—John Sipos

*Attorney, Agent, or Firm*—James A. Wong

[57] ABSTRACT

A self-limiting crimping hook device for coin wrapping machines which as an integral part of the crimping hook assembly, provides a fixed and minimal clearance between the foot of the crimping hook and the end coin of the coin stack, through which the tab of a quick opening pull strip can glide without damage during the rolling of the edge of the wrapping material in the crimping operation.

5 Claims, 5 Drawing Figures

COIN WRAPPING DEVICE

BACKGROUND OF THE INVENTION

1. Field of the Invention

This invention relates to a crimping hook mechanism for coin wrapping machines. More particularly, this invention relates to a crimping hook mechanism for use in a machine wrapping a roll of coins including a quick opening pull strip.

2. State of the Art

It has come to my attention that an interest in the quick and easy opening of rolls of coins has been developed recently. Adding to the state of the art, I have invented a new and improved crimping hook mechanism which is for use in connection with coin rolls provided with a quick opening pull strip and which further is self-limiting.

SUMMARY OF THE INVENTION

With the background discussed above in mind, my invention may be summarized as a new and improved crimping hook mechanism for coin wrapping machines for use in wrapping coins with wrapping material provided with a quick opening pull strip applied thereto prior to wrapping.

It is an object of the present invention to provide a new and improved crimping hook mechanism which will effectively close one end of a roll of coins by crimping the wrapping material and yet will be in self-limiting action and thus provide a minimal clearance between the foot of the crimping hook and the end of the roll to facilitate passage over a quick opening pull strip and/or tab without damaging or destroying such strip and/or tab.

The invention as disclosed has the further purpose of bringing forth a mechanism which will preserve a tab provided on the pull strip during the wrapping process. The strip is attached to the wrapping material prior to wrapping and includes a tab which protrudes beyond the edge of the wrapping material. The material used for the strip is a semi-rigid material, for example polyester film, so that the tab will be sufficiently rigid to undergo the crimping action and to be left protruding from one end of the coin roll.

The disclosed invention is achieved by means of a device in which a first hook extends over and downward with respect to a crimping hook to rest on the end coin of the stack in the proximity of the center of an average sized coin. It performs a self-limiting action to the closing of one of the crimping hooks on the coin stack to assure a minimal clearance between the foot of the crimping hook and the end coin of the coin stack.

The clearance between the foot of the crimping hook and the end coin of the roll or stack must be minimized, but must also be sufficient to allow the tab to glide between it and the end coin during crimping. If there were no such clearance, that is, where no limiting hook is employed, the tab of the strip will become mutilated or be severed. If there is too great a clearance, the edge of the wrapping material which is rolled by the crimping hook will not form a sufficiently tight roll and, consequently, difficulty will be experienced in initiating the tearing of the wrapping of the strip. The necessity for the mechanism according to the present invention when utilizing a strip for a quick opening coin roll is a result of the fact that regardless of the method employed for adjusting the machine to various stack heights, the closing action of the adjustable crimping hook mechanism is limited only by the foot of the crimping hook coming to rest on the end coin of the stack. A limit cannot be accurately pre-set in the machine itself because coins of the same denomination often vary in thickness from either being minted of different thickness or from wear. Consequently, the stack height can vary in height anywhere from zero to a few millimeters. An optimum clearance necessary for the tab of the strip to glide between the foot of the crimping hook and the end coin of the stack should be approximately 0.2 to 0.3 millimeters depending upon the thickness of the tab.

The advantage afforded by my invention presents a very simple way to set a constant clearance between the foot of the crimping hook and the top coin of the stack to be wrapped, and once it is set, it does not have to be changed by the operator of the machine and can be used in wrapping coins of any diameter or denomination. Extensive testing has proven this device to be necessary in order to avoid mutilation and tearing of the tab.

Additional details and characteristics of the invention will be clearly understood upon careful consideration of the drawings listed below and the detailed description of the invention.

DETAILED DESCRIPTION OF THE INVENTION

Figure 1:
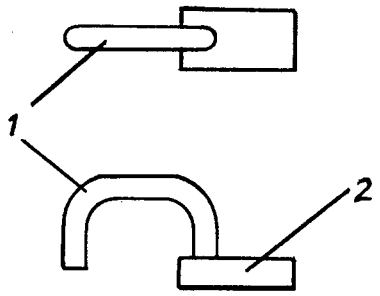
FIG. 1 is a schematic top view and side view of the crimping hook mechanism according to my invention for use as an attachment to an existing crimping hook assembly.
Figure 2:
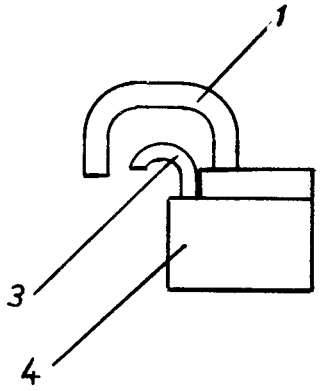
FIG. 2 is a schematic side view showing the mechanism of FIG. 1 mounted on a crimping hook bracket with an enlarged difference in elevation between the foot of a limiting hook and the foot of a crimping hook.
Figure 3:
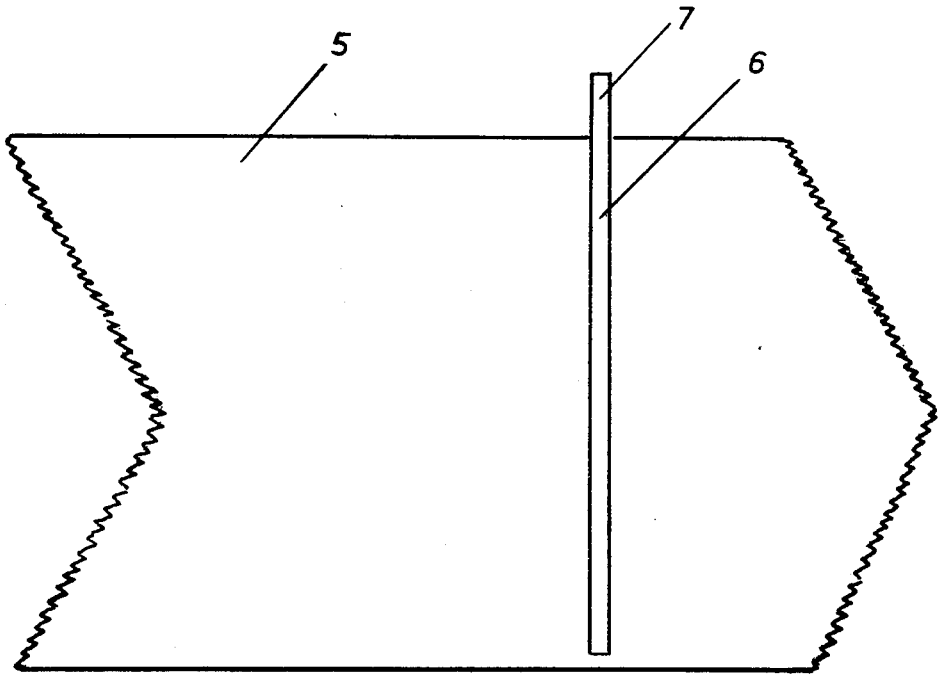
FIG. 3 is a schematic view of a cut section of a coin roll wrapper with a strip applied thereon to provide a quick opening coin roll with a tab.
Figure 4:
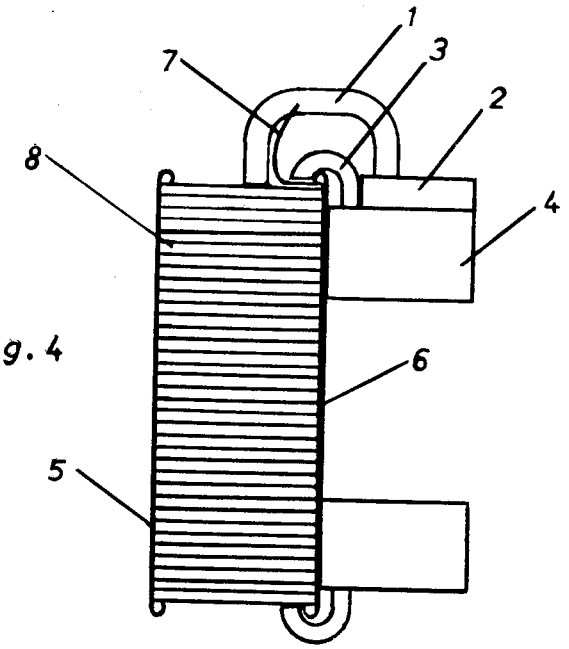
FIG. 4 is a schematic sectional side view of a wrapped coin roll showing the relative positions of the self-limiting hook, crimping hook, and tab during the crimping process.
Figure 5:
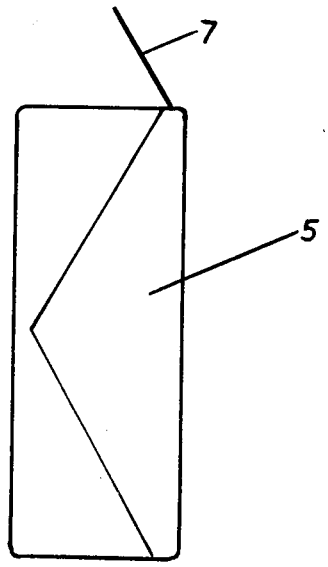
FIG. 5 is a schematic view of a finished coin roll showing the position of a tab after crimping.

As may be readily understood from FIGS. 1, 2, and 4, a device for self-limiting the closing action of a crimping hook 3 during the wrapping process of a roll of coins in a wrapping machine is disclosed. This device comprises in combination a limiting hook 1 and a crimping hook 3 providing a constant clearance between the foot of crimping hook 3 and the top coin of coin stack 8 shown in FIG. 4, during the crimping operation when the upper and lower crimping hooks, as shown in FIG. 4, close upon the coin stack 8. An exaggerated clearance between the foot portions of limiting hook 1 and crimping hook 3 is shown in FIGS. 2 and 4 for clarification only, as the clearance must be minimized to provide a tight rolling action of the edges of the wrapping material 5 during crimping, but at the same time to have sufficient clearance to allow the tab 7 to glide between the foot of crimping hook 3 and the top coin of the coin stack 8. The dimensions and material of the limiting hook device 1 are such as to support the crimping hook 3 closing force without deflection as this device comes to rest on the coin stack 8, thus the fixed clearance described above remains constant. Testing has indicated that it is preferable to have the leading edge of the foot of the crimping hook 3 rounded to provide a gradual entrance for the tab as it enters the clearance space between the foot and the end coin of the stack 8.

It will be obvious to those skilled in the art that various changes may be made without departing from the scope of the invention and the invention is not to be considered limited to what is shown in the drawings and described in the specification.

What is claimed is:

1. A self-limiting device for coin wrapping machines comprising in combination a crimping hook with a foot adapted to extend over the upper surface an end coin of a stack of coins to be wrapped adjacent the periphery of the stack of coins and a limiting hook extending over and beyond said crimping hook and including a foot portion extending radially inwardly from said crimping hook to the proximity of the center of the end coin and axially closer to the end coin than the foot of said crimping hook whereby a clearance is provided between the foot of said crimping hook and the end coin when the foot portion of said limiting hook is resting against the end coin so that a tab of a pull strip attached to the coin wrapper may glide through said clearance between the foot of said crimping hook and the end coin without interference or damage, said crimping hook and said limiting hook having integral support means and further being of such dimensions so as to be serviceable in wrapping stacks of various sizes or denominations of coins.

2. The invention as set forth in claim 1 further characterized by the fact that the limit hook can be formed of 4 mm diameter, hardened steel rod with a horizontal distance from the crimping hook such as to allow the foot of the limit hook to coincide approximately with the center of a coin of 20 mm in diameter, and the height of the hook depending upon the length of the tab and clearance within the machine to be an integral part of a mounting plate which can be fastened to the mounting bracket of the crimping hook used on existing machines.

3. The invention as set forth in claims 1 or 2 further characterized by the fact that a minimal clearance which is slightly greater than the thickness of the tab of the pull strip, is set as the difference in the amount the foot of the limiting hook extends below the foot of the crimping hook.

4. The invention as set forth in claims 1 or 2 further characterized by the fact that the limit hook may be fabricated as an integral part of the crimping hook's mounting bracket for new machines or for replacement parts.

5. The invention as set forth in claims 1 or 2 further characterized by the fact that the foot of the limit hook is ground slightly convex.

* * * * *